United States Patent [19]

Parks

[11] Patent Number: 5,005,308

[45] Date of Patent: Apr. 9, 1991

[54] TILT INDICATOR FOR FIREARM SCOPES

[76] Inventor: William K. Parks, P.O. Box 134, Lipan, Tex. 76462

[21] Appl. No.: 455,622

[22] Filed: Dec. 22, 1989

[51] Int. Cl.[5] ..... F41G 1/38

[52] U.S. Cl. ..... 42/101; 33/245; 33/366

[58] Field of Search ..... 33/245, 265, 275 R, 33/354, 366; 42/101; 200/220

[56] References Cited

U.S. PATENT DOCUMENTS

| | | | |
|---|---|---|---|
| 2,173,142 | 9/1939 | Thurlow et al. . | |
| 2,243,793 | 5/1941 | Cummins | 33/245 |
| 3,161,716 | 12/1964 | Burris et al. . | |
| 3,313,026 | 7/1965 | Akin, Jr. . | |
| 3,556,666 | 1/1971 | Lichtenstern . | |
| 4,110,609 | 8/1978 | Beer | 33/366 |
| 4,325,190 | 4/1982 | Duerst | 33/265 |

FOREIGN PATENT DOCUMENTS

| | | | |
|---|---|---|---|
| 978737 | 12/1975 | Canada | 33/366 |

*Primary Examiner*—Deborah L. Kyle
*Assistant Examiner*—Richard W. Wendtland
*Attorney, Agent, or Firm*—Melvin A. Hunn

[57] ABSTRACT

A firearm scope which is coupled in axial alignment with a firearm barrel includes a number of components. A tubular scope barrel is provided. An objective lens assembly is coupled to one end of the tubular scope barrel for receiving a target image. An erector lens assembly is disposed within the tubular scope for processing the target image. An ocular lens assembly is coupled to the opposite end of the tubular scope barrel for viewing the target image. A reticle is provided in the tubular scope barrel, and is visible through the ocular lens for defining an aiming point in the target image. A means for visually indicating the tilt of the firearm scope and barrel from vertical is provided in the tubular scope barrel, and is visible through the ocular lens assembly.

13 Claims, 2 Drawing Sheets

TILT INDICATOR FOR FIREARM SCOPES

BACKGROUND OF THE INVENTION

1. Field of the Invention

The present invention relates generally to firearm scopes, and specifically to device which increases the accuracy of firearms.

2. Description of the Prior Art

Firearm scopes are designed to compensate for the effect of gravity on bullets. Generally, the firearm barrel is carried at a slight upward angle relative to the firearm scope to project the bullet through an arc. Of course, since the firearm scope is aligned with the selected target, accuracy is optimized if the bullet's trajectory and the line of sight established by the firearm scope coincide a selected distance from the firearm. Highly accurate mechanisms are provided in firearm scopes to allow minute adjustments of the firearm scope to ensure that the scope sight and the bullet trajectory intersect.

The way the firearm is held by the shooter can have an impact on the firearm accuracy which is far from insignificant. Side to side tilt of the firearm is one significant source of inaccuracy. This "tilt" is often referred to as "canting" of the firearm. Most hunters and marksmen rely on their inner sense of balance to ensure that the firearm is not canted. This attitude presupposes that the shooter has a fully functional, unimpaired sense of balance, and that this sense of balance can somehow be translated over into the handling of the firearm.

Studies of airplane pilots reveal that the human sense of balance is easily confused by a number of influences, and that the pilot should disregard his or her feelings and trust the plane's instruments. The human sense of balance is likewise subject to a number of disorienting influences including rifle recoil, the loud sounds associated with shooting, the repeated focusing on distant targets as viewed through one eye, and prolonged periods of standing. A hunter is subjected to even more disorienting influences, including the elements (heat, cold, wind, rain, etc.) and rough and uneven terrain. In addition, hunters may spend hours of hiking through rough and unlevel terrain before firing one shot. Surely, the human sense of balance can be confused under such circumstances. However, mechanisms which alert the marksman or hunter to a tilt or cant in the bearing of his or her firearm have not been provided in firearm scopes.

SUMMARY OF THE INVENTION

It is one object of the present invention to provide a firearm scope which includes a means for detecting and indicating tilt of said firearm scope and barrel.

It is another object of the present invention to provide a firearm scope which includes a means for detecting and indicating tilt of said firearm scope and barrel, which is visible through the ocular lens assembly of the firearm scope.

It is yet another object of the present invention to provide a means for detecting and indicating tilt of a firearm scope and barrel, which is visible through the ocular lens assembly of the firearm scope along the periphery of the target image, and in the same optical plane as the firearm reticle.

The foregoing objects are achieved as is now described. A firearm scope which is coupled in axial alignment with a firearm barrel includes a number of components. A tubular scope barrel is provided. An objective lens assembly is coupled to one end of the tubular scope barrel for receiving a target image. An erector lens assembly is disposed within the tubular scope for processing the target image. An ocular lens assembly is coupled to the opposite end of the tubular scope barrel for viewing the target image. A reticle is provided in the tubular scope barrel, and is visible through the ocular lens for defining an aiming point in the target image. A means for visually indicating the tilt of the firearm scope and barrel from vertical is provided in the tubular scope barrel, and is visible through the ocular lens assembly.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THEINVENTION

Figure 1:
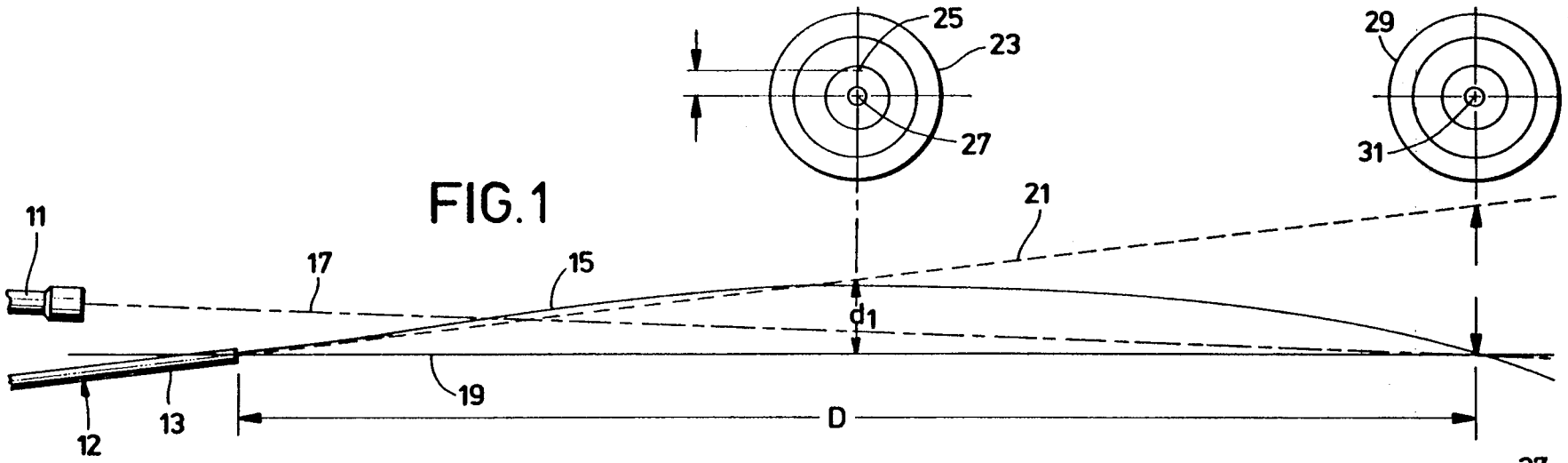
FIG. 1 is a graphic depiction of the interrelationship between the line of sight established by a firearm scope and the bullet trajectory, when no tilt of the firearm scope and barrel is present.

FIG. 1 is a graphic depiction of the interrelationship between the line of sight 17 established by firearm scope 11 and the bullet trajectory 15 established by slightly uplifted firearm 12 barrel 13. Reference line 19 is provided as a horizontal reference. Line 21 emanates from firearm barrel 13, and shows the bullet trajectory, without the affect of gravity. Of course, gravity operates on the bullet to pull it downward; therefore, trajectory 15 graphically depicts a trajectory which compensates for the affect of gravity to allow line of sight 17 established by firearm scope 11 to coincide with bullet trajectory 15 a selected distance D from firearm barrel 13. The coincidence of trajectory 15 and line of sight 17 are graphically depicted by target 29. Target 27 graphically depicts the variance between line of sight 17 and trajectory 15 at a midpoint along trajectory 15. Note that the bullet trajectory 15 is elevated from bull's-eye 27 a distance d1.

As discussed above, highly accurate known mechanisms are provided in firearm scopes to allow minute adjustments of the firearm scope to ensure that the scope sight and the bullet trajectory intersect at a selected distance from the firearm.

Figure 2:
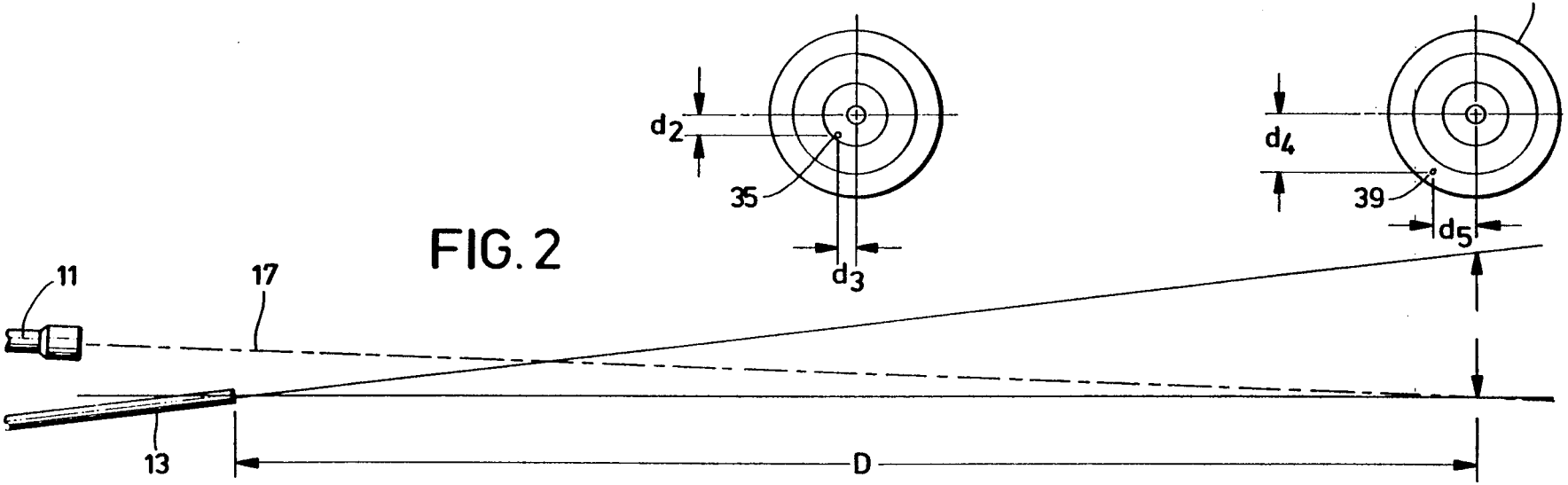
FIG. 2 is a graphic depiction of the interrelationship between the line of sight established by a firearm scope and the bullet trajectory, when a tilt of the firearm scope and barrel is present.

FIG. 2 is a graphic depiction of the interrelationship of the line of sight 17 established by firearm scope 11 and the bullet trajectory, when a tilt of firearm scope 11 and barrel 13 is present. When tilt is present, the trajectory of the bullet cannot be depicted with accuracy in a two-dimensional drawing; therefore, targets 33 and 37 are used to depict the bullet trajectory. As shown by FIG. 2, when firearm 12 is tilted counterclockwise the bullet will not fly on its projected course. Rather, the bullet will be significantly off course. Target 33 depicts bullet hole 35 which illustrates the trajectory at a midpoint along distance D. The bullet trajectory is too far to the left by a distance d3 and too far below the bull's-eye by a distance d2. At the selected distance D, as shown in target 37, bullet hole 39 is too far below the bull's-eye by a distance d4 and too far to the left of the bull's-eye by a distance d5.

Figure 3:
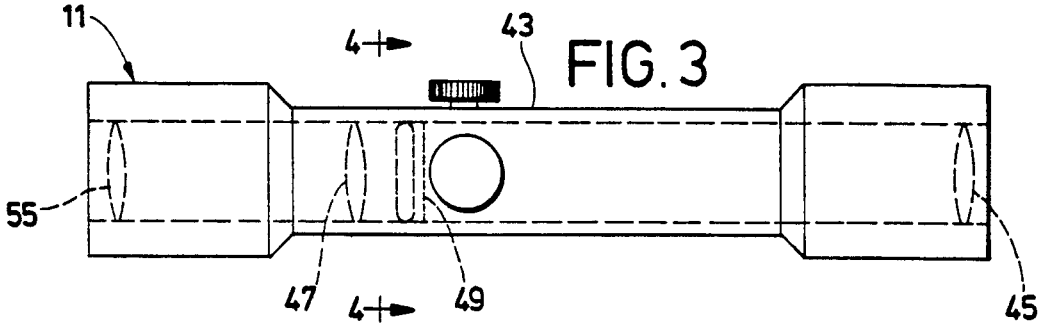
FIG. 3 is a simplified partial longitudinal section view of one embodiment of the improved firearm scope of the present invention.

FIG. 3 is a simplified partial longitudinal section view of one embodiment of the improved firearm scope 11 of the present invention. Firearm scope 11 includes tubular scope barrel 43, objective lens assembly 45 coupled to one end of tubular scope barrel 43. Of course, objective lens assembly 45 may contain a plurality of lenses; but for purposes of exposition, it is shown in simplified form in FIG. 3. Objective lens assembly 45 serves to receive a target image and direct it inward along tubular scope barrel 43. Typically, the objective lens assembly will invert and reverse the target image.

Erector lens assembly 47 is disposed within tubular scope barrel 43, for processing the target image. Of course, erector lens assembly 47 is shown in simplified form in FIG. 3, and may include a plurality of optical lenses for processing the target image. Typically, erector lens assembly serves to invert and reverse the image that leaves objective lens assembly 45.

Ocular lens assembly 55 is coupled to the opposite end of tubular scope barrel 43 for viewing the target image. Typically, optical lens assembly 55 serves to magnify the image transmitted from erector lens assembly 47.

Figure 4A:
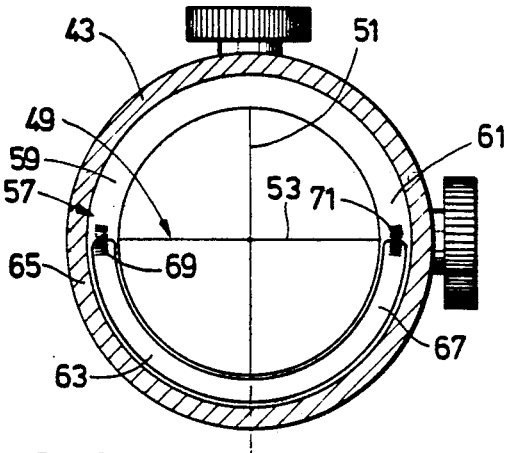
FIGS. 4A and 4B are cross-section views of the firearm scope of FIG. 3 as seen along line IV—IV.

FIGS. 4A and B are cross-section views of the firearm scope of FIG. 3 as seen along IV—IV. Reticle 49 is shown disposed within tubular scope barrel 43. Reticle 49 comprises vertical cross hair 51, and horizontal cross hair 53, which intersect at a center point to aid in targeting. Fluid filled chamber 57 is disposed along the inner periphery of tubular scope barrel 43. In the preferred embodiment, fluid filled chamber 57 comprises a toroidal glass chamber, which is filled with fluid 53. Fluid filled chamber 57 includes first transparent vertical side chamber 59 and second transparent vertical side chamber 61. Vertical side chambers 59, 61 serve to hold fluid columns 65, 67 respectively, which are visible through the ocular lens assembly 55 and which indicate tilt of the firearm scope 11 and barrel 13 by their position within the first and second transparent vertical side chambers 59, 61. Hash marks 69, 71 may be provided on first and second transparent vertical side chambers 59, 61 to indicate the degree of tilt of the firearm scope 11 and barrel 13. Hash marks 69, 71 may be coordinated with horizontal cross hair 53 of reticle 49 to indicate the level position. In other words, the horizontal cross hair 53 may serve, along with hash marks 69, 71, as an indicator of level position.

Figure 4B:
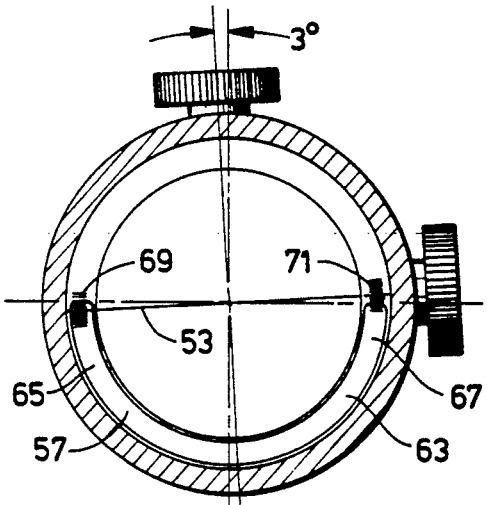

FIG. 4B depicts the reaction of fluid filled chamber 57 to a slight tilt of firearm scope 11. As shown, if firearm scope il is tilted one degree counterclockwise from its position in FIG. 4A, fluid 63 in fluid filled chamber 57 will be effected. Specifically, fluid column 65 in first transparent vertical side chamber 59 will become slightly elevated relative to horizontal cross hair 53 and hash marks 69. In addition, fluid column 67 in second transparent vertical side chamber 61 will be slightly depressed relative to horizontal cross hair 53 and hash marks 71. If firearm scope 11 is tilted in the opposite direction, fluid column 65 will be slightly depressed relative to horizontal cross hair 53, while fluid column 67 will be slightly elevated relative to horizontal cross hair 53.

The embodiment of the present inventions shown in FIGS. 4A and B may be considered an analog tilt indicator, insofar as degrees of tilt may be indicated by hash mark 69, 71. The shooter may find a certain range of tilt to be acceptable for his or her shooting purposes.

Figure 5:
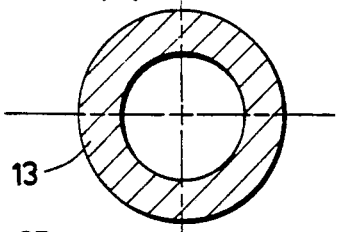
FIG. 5 is an electrical schematic of an alternate embodiment of the present invention.
Figure 5:
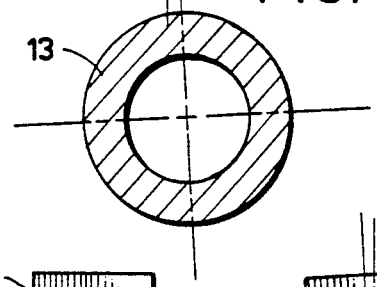
Figure 5:
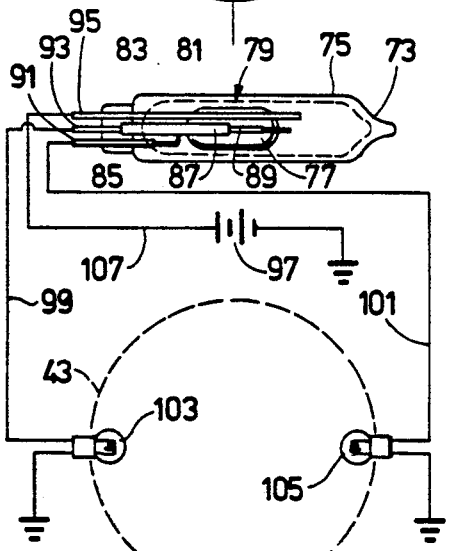

FIG. 5 is an electrical schematic of an alternate embodiment of the present invention. This alternate embodiment includes mercury switch 17, which comprises glass chamber 75 which encloses mercury bead 77. A plurality of electrical contactors 79 are provided within glass chamber 75, including contactors 81, 83, and 85. These contactors are of differing lengths, to allow mercury bead 77 to complete electrical contact between contactor 81, which always engages mercury bead 73, and contactors 83, 85 which will contact mercury bead 77 only when glass chamber 75 is tilted to one direction. More specifically, mercury bead 73 completes electrical contact between contactor 81 and contactor 83 when glass chamber 75 is tilted clockwise. Alternately, mercury bead 77 completes electrical contact between contactors 81 and 85 only when glass chamber 75 is tilted counterclockwise. Contactor 83 is equipped with insulation barrier 87, and an electrically conductive tip 89, to prevent electrical conduction between contactor 81 and contactor 83 when mercury bead 77 is in the left hand side of glass chamber 75.

A plurality of terminals are also included in mercury switch 73, including terminals 91 93, and 95. Terminal 95 couples contactor 81 to battery 97 through conductor 107. Terminal 93 couples contactor 83 to bulb 103 through conductor 99. Terminal 91 couples contactor 85 to bulb 105 through conductor 101. When mercury bead 77 electrically couples contactors 81 and 83, battery 97 is applied to (and energizes) bulb 103. Alternately, when mercury bead 77 electrically couples contactors 81 and 85, battery 97 energizes bulb 105. In the preferred embodiment, mercury switch 73 comprises a Microswitch brand mercury switch by Honeywell, Inc. of Freeport, IL, Model No. AS691A0. Of course, alternate switching means may be employed to energize bulbs 103, 105 in response to tilt of firearm scope 11.

In the configuration shown in FIG. 5, clockwise tilt of firearm scope 11 will result in actuation of bulb 103, indicating to the shooter that the scope should be slightly tilted in the counterclockwise direction to compensate for the detected tilt. Alternately, when firearm scope 11 is tilted in a counterclockwise direction, bulb 105 is energized to indicate that the firearm should be slightly tilted in the clockwise direction to compensate for the detected tilt. Of course, the wiring can be reversed to provide alternate signaling.

Figure 6A:
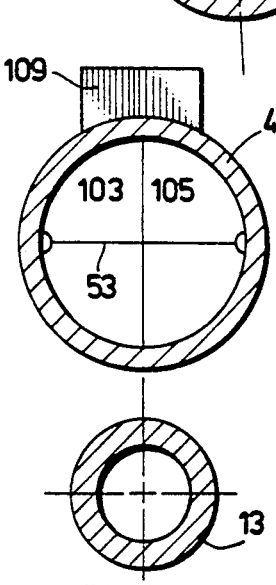
FIGS. 6A and 6B are cross-section views of the improved firearm scope of FIG. 3, equipped with the alternate tilt detection device, as seen along lines IV—IV of FIG. 3.
Figure 6B:
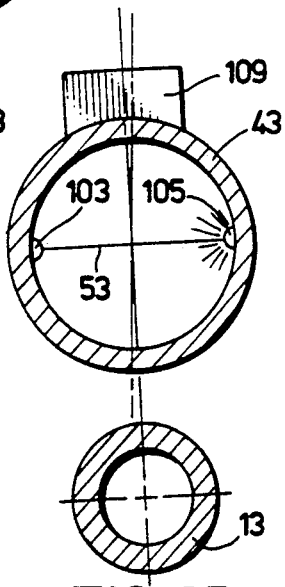

FIGS. 6A and B are cross-section views of the improved firearm scope of FIG. 3, equipped with the alternate tilt detection device, as seen along lines IV—IV of FIG. 3. In FIGS. 6A and B, bulbs 103, 105 are visible along the periphery of the target image, in alignment with horizontal cross hair 53. Switch housing 109 is provided directly aboVe tubular scope barrel 43, and serves to house mercury switch 73. FIG. 6B depicts firearm scope 11 slightly tilted in a counterclockwise direction. Accordingly, bulb 105 is actuated by mercury switch 73 to indicate to the shooter that the firearm should be slightly tilted in a clockwise direction to compensate for the detected tilt. If firearm 12 is overly compensated, bulb 103 will be actuated to direct compensation in the opposite direction. Of course, the wiring of bulbs 103, 105 may be reversed to provide opposite indicator signaling. The shooter can be instructed to respond to the actuation of bulbs 103, 105 appropriately. Finally, the sensitivity of mercury switch 73 may be adjusted by substituting alternate mercury switches which are less sensitive to tilt.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An improved firearm scope for coupling to a firearm in axial alignment with the firearm barrel, which is subjected to shocks when said firearm is discharged, comprising:

a tubular scope barrel;

an objective lens assembly coupled to one end of said tubular scope barrel for receiving a target image;

an erector lens assembly disposed within said tubular scope barrel for processing said target image;

an ocular lens assembly coupled to the opposite end of said tubular scope barrel for viewing said target image;

a reticle visible through said ocular lens for defining an aiming point in said target image;

wherein accuracy of said firearm is optimized when said firearm scope and firearm barrel are held substantially vertically; and an electrically actuated indicator for providing an illuminated visual display indicating tilt of said firearm scope and barrel from vertical, which is visible through said ocular lens assembly when electrically illuminated, which is physically stationary relative to said reticle, and which does move relative to said reticle in response to shock when said firearm is discharged.

2. An improved firearm scope for coupling to a firearm in axial alignment with the firearm barrel according to claim 1, wherein said means for visually indicating is visible in one optical plane with said reticle and said target image.

3. An improved firearm scope for coupling to a firearm in axial alignment with the firearm barrel according to claim 1, wherein said means for visually indicating provides at least one binary indication of tilt of said firearm scope and barrel.

4. An improved firearm scope for coupling to a firearm in axial alignment with the firearm barrel according to claim 1, wherein said means for visually indicating provides at least one binary indication of lack of tilt of said firearm scope and barrel.

5. An improved firearm scope for coupling to a firearm in axial alignment with the firearm barrel according to claim 1, wherein said means for visually indicating provides an indication of tilt of said firearm scope and barrel, visible through said ocular lens assembly at the periphery of said target image.

6. An improved firearm scope for coupling to a firearm in axial alignment with the firearm barrel according to claim 1, wherein said reticle includes vertical and horizontal cross hairs, and wherein said means for visually indicating provides an indication of tilt of said firearm scope and barrel relative to said horizontal cross hair.

7. An improved firearm scope for coupling to a firearm in axial alignment with the firearm barrel, comprising:

a tubular scope barrel;

an objective lens assembly coupled to one end of said tubular scope barrel for receiving a target image;

an erector lens assembly disposed within said tubular scope for processing said target image;

an ocular lens assembly coupled to the opposite end of said tubular barrel for viewing said target image;

a reticle visible through said ocular lens for defining an aiming point in said target image;

wherein accuracy of said firearm is optimized when said firearm scope and firearm barrel are held substantially vertically;

a mercury switch coupled to said tubular scope barrel, including a mercury bead within a chamber for closing a first electrical circuit between two switch terminals when tilted beyond a selected angle in one direction, and for closing a second electrical circuit between two switch terminals when tilted beyond a selected angle in the opposite direction;

a first electrically actuated indicator disposed in said tubular scope barrel, and visible through said ocular lens assembly on one side of said target image, electrically coupled to said mercury switch and energized in response to tilt in one direction of said firearm scope and barrel; and a second electrically actuated indicator disposed in said tubular scope barrel, and visible through said ocular lens assembly on the opposite side of said target image, electrically coupled to said mercury switch and energized in response to tilt in one direction of said firearm scope and barrel.

8. An improved firearm scope for coupling to a firearm in axial alignment with the firearm barrel, comprising:

a tubular scope barrel;

an objective lens assembly coupled to one end of said tubular scope barrel for receiving a target image;

an erector lens assembly disposed within said tubular scope for processing said target image;

an ocular lens assembly coupled to the opposite end of said tubular barrel for viewing said target image;

a reticle visible through said ocular lens for defining an aiming point in said target image;

wherein accuracy of said firearm is optimized when said firearm scope and firearm barrel are held substantially vertically;

a mercury switch coupled to said tubular scope barrel, including a mercury bead within a chamber for closing a first electrical circuit between two switch terminals when tilted beyond a selected angle in one direction, and for closing a second electrical circuit between two switch terminals when tilted beyond a selected angle in the opposite direction; and at least one electrically actuated indicator disposed in said tubular scope barrel, and visible through said ocular lens assembly, electrically coupled to said mercury switch and energized in response to tilt in said firearm scope and barrel.

9. An improved firearm scope according to claim 8, wherein said at least one electrically actuated indicator is physically stationary relative to said reticle.

10. An improved firearm scope for coupling to a firearm in axial alignment with the firearm barrel, comprising:

a tubular scope barrel;

a plurality of axially aligned lens assemblies carried by said tubular scope barrel for receiving and processing said target image;

at least one electrical switch coupled to said tubular scope barrel, each including an electrically conductive bead of fluid within a chamber, for closing electrical contacts when tilted in either direction beyond a selected angle; and at least one electrically actuated indicator disposed in said tubular scope barrel, and visible through said plurality of axially aligned lens assemblies, electrically coupled to said at least one electrical switch and energized in response to tilt in said firearm scope and barrel.

11. An improved firearm scope according to claim 10, wherein said at least one electrically actuated indicator which is physically stationary relative to said tubular scope barrel.

12. An improved firearm scope according to claim 10, wherein said at least one electrically actuated indicator comprises at least one electrically actuated light source disposed within said tubular barrel which is switched between illuminated and non-illuminated modes in response to movement of said electrically conductive bead of fluid when tilt occurs.

13. An improved firearm scope according to claim 10, wherein said at least one electrically actuated indicator provides a binary indication of whether said firearm is tilted.

* * * * *